US006672902B2

(12) United States Patent
Skinner et al.

(10) Patent No.: US 6,672,902 B2
(45) Date of Patent: Jan. 6, 2004

(54) REDUCING ELECTROMAGNETIC INTERFERENCE (EMI) EMISSIONS

(75) Inventors: Harry G. Skinner, Beaverton, OR (US); Steve Y. Chang, West Linn, OR (US); Howard L. Heck, Hillsboro, OR (US); Yun Ji, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 180 days.

(21) Appl. No.: 10/017,456

(22) Filed: Dec. 12, 2001

(65) Prior Publication Data

US 2003/0109175 A1 Jun. 12, 2003

(51) Int. Cl.[7] ..... H01R 13/648
(52) U.S. Cl. ..... 439/607; 174/35 R
(58) Field of Search ..... 174/35 R; 439/607; 361/816, 818

(56) References Cited

U.S. PATENT DOCUMENTS 4,404,617 A * 9/1983 Ohyama et al. ..... 174/35 R
4,717,990 A * 1/1988 Tugcu ..... 174/35 R
4,931,479 A * 6/1990 Morgan ..... 521/76
4,964,017 A * 10/1990 Jindrick et al. ..... 361/682
5,155,316 A * 10/1992 Chiu ..... 174/35 MS
5,244,708 A * 9/1993 Tsuchida et al. ..... 174/35 R
5,278,351 A * 1/1994 Herrick ..... 174/35 R
5,473,110 A * 12/1995 Johnson ..... 174/35 GC
5,562,497 A * 10/1996 Yagi et al. ..... 439/610
5,583,318 A * 12/1996 Powell ..... 174/35 MS
5,676,812 A * 10/1997 Kadokura ..... 174/35 R
6,018,125 A * 1/2000 Collins et al. ..... 174/35 R
6,046,652 A * 4/2000 Deiso et al. ..... 333/12
6,114,622 A * 9/2000 Draeger ..... 174/35 R
6,137,694 A * 10/2000 Kerrigan et al. ..... 174/35 MS
6,140,577 A * 10/2000 Rapaich et al. ..... 174/35 R
6,242,691 B1 * 6/2001 Reese et al. ..... 174/35 R
6,278,606 B1 * 8/2001 Schmitt et al. ..... 361/683
6,309,742 B1 * 10/2001 Clupper et al. ..... 428/304.4
6,346,491 B1 * 2/2002 DeAngelis et al. ..... 442/110
6,359,213 B1 * 3/2002 Long ..... 174/35 R
6,410,847 B1 * 6/2002 Allen et al. ..... 174/35 MS
2002/0046849 A1 * 4/2002 Rapp et al. ..... 174/35 R
2002/0104670 A1 * 8/2002 Marmel ..... 174/35 R

* cited by examiner

*Primary Examiner*—Hae Moon Hyeon
(74) *Attorney, Agent, or Firm*—Fish & Richardson P.C.

(57) ABSTRACT

A system includes a chassis having at least one wall, the chassis housing electrical components and a layer of flexible foam electromagnetic interference (EMI) emission absorption material covering an interior surface of the wall. A system also includes a chassis containing slots, the chassis housing electrical components and a layer of flexible foam electromagnetic interference (EMI) emission absorption material covering at least one of the slots.

26 Claims, 3 Drawing Sheets

REDUCING ELECTROMAGNETIC INTERFERENCE (EMI) EMISSIONS

FIELD OF THE INVENTION

This invention relates to reducing electromagnetic interference (EMI) emissions.

BACKGROUND

During the operation of computers, or other similar electronic components, electromagnetic interference (EMI) emissions, or radiation, are generated by motors, drives, processors, chips and circuits. One way to contain these emissions is to surround the circuit in a metal panel. Further, in some situations, these emissions must be contained in order to comply with certain regulations.

DETAILED DESCRIPTION

Figure 1:
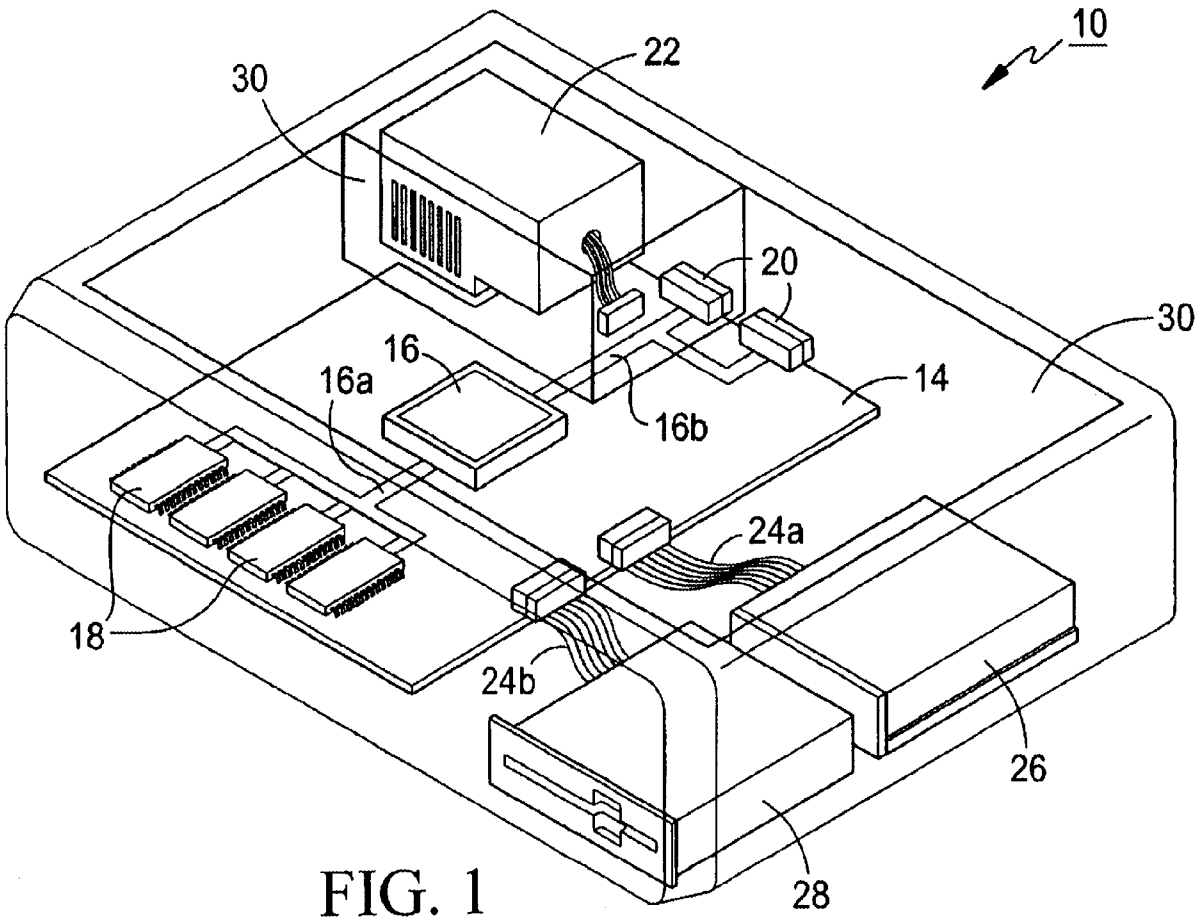
FIG. 1 is a block diagram of a first embodiment.

Referring to FIG. 1, a computer 10 includes a metal or plastic chassis 12 in which a motherboard 14 is mounted. A chassis is the physical frame or structure of a computer that houses the main electronic components, including the motherboard 14 with places (not shown) to insert or replace microchips for the main and possibly specialized processors and random access memory (RAM) and places for adding optional adapters like audio or video capabilities, for example. Typically, room is also provided for a hard-disk drive and a CD-ROM drive. A processor 16 is connected to the motherboard 14. A number of memory devices or modules 18 and two input/output (I/O) devices 20 are also mounted to the motherboard 14. Two buses 16*a* and 16*b* are also provided on the motherboard 14 and connect the processor 16 to the memory modules 18 and to the input/output devices 20, respectively. A power supply 22 is connected to the motherboard 14 and a pair of cable assemblies 24*a* and 24*b* connect the motherboard 14 to a hard drive unit 26 and a disk drive 28. Other components (not shown), electrical traces, electrical circuits and related devices may also be provided in the chassis 12.

At least part of the interior walls of the chassis 12 is covered with a layer 30 of electromagnetic interference (EMI) emission absorption material. The layer 30 is affixed to the interior walls of chassis 12 and absorbs electromagnetic emissions. For example, in a personal computer where the chassis 12 may be expected to provide 6 dB attenuation of EMI emission, the layer 30 can absorb 6 dB of the EMI emission. In another example, the layer 30 can protect sensitive components in a wireless device from emissions from circuitry or transmitting antenna. Rather than containing EMI emissions, the layer 30 absorbs the EMI emissions. One or more layers of EMI emission absorption materials can easily be applied to all computer-type systems, such as work stations, desktop computers, servers, as well as any electronic device, such as personal data assistants (PDAs), wireless devices, internet tables, game consoles and peripherals.

Figure 2:
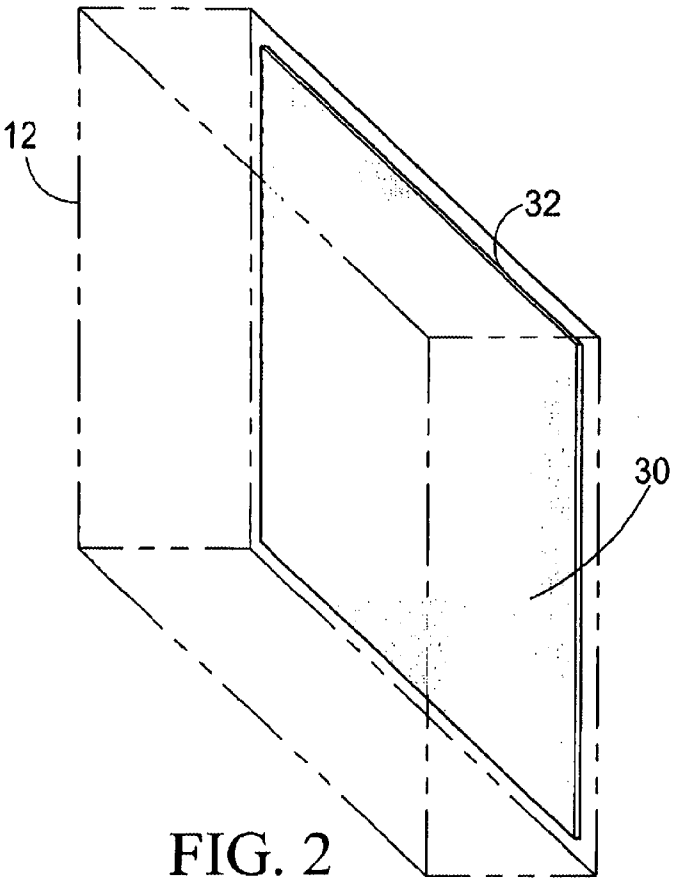
FIG. 2 is a block diagram of a second embodiment.

Referring to FIG. 2, the layer 30 is shown attached to an interior of a side panel 32 of the chassis 12. An adhesive is used to bond the layer 30 to the side panel 32 during manufacturing and assembly of the chassis 12 and sized to the dimensions of the interior portion of the side panel 32 of the chassis 12. No electrical grounding is required. The layer 30 may be fabricated in a variety of thicknesses to cover a wide range of EMI emission ranges. For example, the layer 30 may be constructed as a lightweight, flexible, low density, and high-loss foam. Thickness may range, for example, from 0.01" to 1.0", and densities may range, for example, from 0.05 to 5.0 pounds per cubic foot, however the thickness and densities are not limited to these values. The layer 30 may be single layer, multilayer, weatherproof, reticulated and or rigid. Suitable EMI emission absorber material is supplied, for example, by R+F Products of San Marcos, Calif. and ARC Technologies of Amesbury, Mass.

Figure 3:
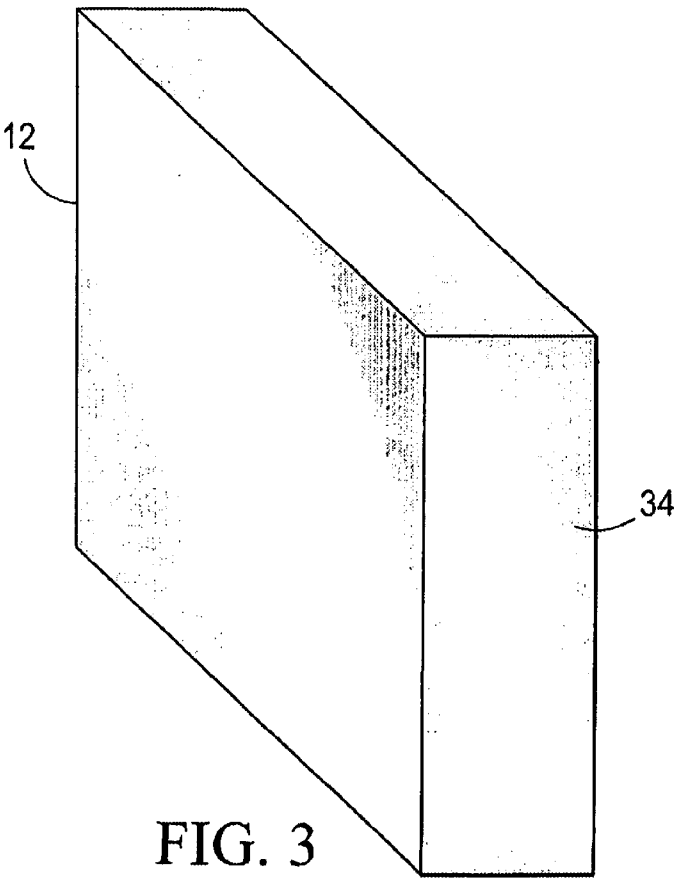
FIG. 3 is a block diagram of a third embodiment.

Referring to FIG. 3, in another approach, the chassis 12 may be fitted with a molded, i.e., rigid, EMI emission absorption panel 34 that replaces a metal or plastic panel of FIG. 1. The panel 34 is, for example, a reticulated foam with a continuously graded lossy coating produced using a two part closed cell polyurethane filler to provide structural integrity. Thus, rather than bonding a layer 30 to the interior walls of the chassis 12, the front panel 34 replaces the front wall of the chassis with a rigid material capable of EMI emission absorption.

Figure 4:
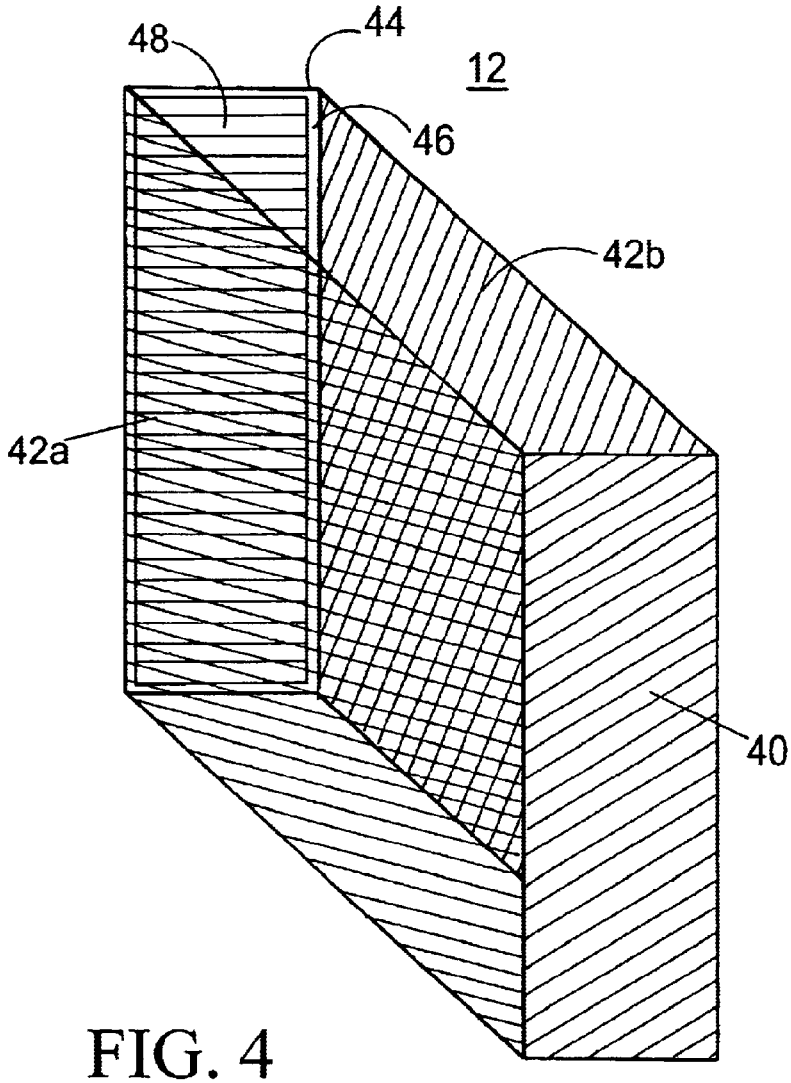
FIG. 4 is a block diagram of a fourth embodiment.

Referring to FIG. 4, in still another approach, the chassis 12 includes a front panel 40 of rigid EMI absorption material and two side panels 42*a*, 42*b* of rigid EMI absorption material. A back panel 44 has attached on an interior surface 46 a panel 48 of flexible EMI absorption material.

In other examples, one or more of the interior and/or exterior metal or plastic walls of the chassis 12 are replaced with solid molded EMI emission absorption panels. Use of the molded EMI emission absorption panels also provides thermal venting since it is porous and not impermeable. Further, combining a different EMI emission absorption material in a single panel or layer covers a very wide frequency band.

In still other examples, layers of EMI emission absorption materials are used to line internal bays within the chassis, like, for example, a bay in which the power supply 22 resides.

In another example, where slots are common in computer peripherals for assembly and thermal reasons, radiation from these slots may cause EMI problems. Layers of EMI emission absorption materials are used to suppress EMI around slots in computer peripherals, such as CD-ROMs, DVDs, CD-RWs and floppy/disk drives.

Other embodiments are within the following claims.

What is claimed is:

1. A system comprising:

a chassis having at least one wall, the chassis housing electrical components; and a layer of flexible, lightweight, low density, high-loss foam electromagnetic interference (EMI) emission absorption material covering an interior surface of the wall, the material having a thickness of 0.01" to 1.0" and a density of 0.05 to 5 pounds per cubic foot.

2. The system of claim 1 wherein the layer comprises a single layer of lossy foam.

3. The system of claim 1 wherein the layer comprises multiple layers of lossy foam.

4. The system of claim 1 wherein the layer comprises a layer of weatherproof lossy foam.

5. The system of claim 1 in which the layer covers all walls within the chassis.

6. The system of claim 1 in which the layer covers more than one wall within the chassis.

7. The system of claim 1 in which another wall is made entirely of a rigid EMI emission absorption material.

8. Apparatus comprising:

an electrical chassis, at least one rigid reticulated foam with a continuously graded lossy coating produced using a two part closed cell polyurethane filler connected to a plurality of non-shielded walls.

9. Apparatus comprising:

panels joined to form a chassis;

at least one bay located within an interior of the chassis, the bay having at least one wall; and a layer of flexible, lightweight, low density, high-loss foam EMI emission absorption material affixed to an interior surface of the wall of the bay, the material having a thickness of 0.01" to 1.0" and a density of 0.05 to 5 Pounds per cubic foot.

10. The apparatus of claim 9 in which a second wall is constructed from a rigid foam EMI emission absorption material.

11. An enclosure comprising:

a front panel constructed from a rigid reticulated foam with a continuously graded lossy coating produced using a two part closed cell polyurethane filler and joined to two side panels, an upper panel and a lower panel; and a rear panel joined to the two side panels and upper and lower panels.

12. The enclosure of claim 11 in which the two side panels are constructed of a rigid reticulated foam EMI emission absorption material.

13. The enclosure of claim 11 in which the upper and lower panels are constructed of a rigid reticulated foam EMI emission absorption material.

14. The enclosure of claim 11 further comprising internal bays having walls lined with a flexible foam EMI emission absorption material.

15. The enclosure of claim 11 further comprising internal bays having walls constructed of a rigid reticulated foam EMI emission absorption material.

16. A method comprising:

forming a front panel from a rigid reticulated foam with a continuously graded lossy coating produced using a two part closed cell polyurethane filler; and joining the front panel to a top and bottom panel, two side panels and a back panel.

17. The method of claim 16 further comprising:

providing internal bays having metal walls; and covering the metal walls with a first layer of flexible foam EMI emission absorption material.

18. The method of claim 17 further comprising covering the metal walls with a second layer of foam EMI emission absorber material.

19. The method of claim 16 further comprising covering an interior side of the top and bottom wall with a flexible foam EMI emission absorption material.

20. The method of claim 16 further comprising covering an interior surface of the back panel with a flexible foam EMI emission absorption material.

21. The method of claim 16 further comprising covering an interior surface of the two side panels with a flexible foam EMI emission absorption material.

22. A system comprising:

a chassis containing a plurality of slots, the chassis housing electrical components; and a layer of flexible, lightweight, low density, high-loss foam electromagnetic interference (EMI) emission absorption material covering at least one of the slots, the material having a thickness of 0.01" to 1.0" and a density of 0.05 to 5 pounds per cubic foot.

23. The system of claim 22 wherein the layer comprises a single layer of lossy foam.

24. The system of claim 22 wherein the layer comprises multiple layers of lossy foam.

25. The system of claim 22 wherein the layer comprises a layer of weatherproof lossy foam.

26. The system of claim 22 in which the layer covers more than one slot.

* * * * *